United States Patent [19]

Kikuchi

[11] 4,321,868

[45] Mar. 30, 1982

[54] ROTARY TYPE RUBBER STAMP

[76] Inventor: Naokazu Kikuchi, 6-6 Higashi-jujo 5-chome, Kita-ku, Tokyo, Japan

[21] Appl. No.: 93,980

[22] Filed: Nov. 14, 1979

[30] Foreign Application Priority Data

Oct. 18, 1978 [JP] Japan ..... 53-143140

[51] Int. Cl.[3] ..... B41J 1/32

[52] U.S. Cl. ..... 101/111

[58] Field of Search ..... 101/111; 74/527, 105

[56] References Cited

U.S. PATENT DOCUMENTS

| | | | |
|---|---|---|---|
| 710,380 | 9/1902 | Turck | 101/350 X |
| 862,396 | 8/1907 | Heller | 101/111 |
| 1,143,445 | 6/1915 | Scotford | 101/111 |
| 1,450,627 | 4/1923 | Darnley | 101/111 X |
| 2,465,720 | 3/1949 | Flamm | 74/527 |
| 3,380,378 | 4/1968 | Edwards et al. | 101/111 X |
| 3,776,062 | 12/1973 | Ito | 74/527 X |
| 3,786,693 | 1/1974 | Keipert | 74/527 |
| 3,796,152 | 3/1974 | Finke et al. | 101/111 |
| 3,927,613 | 12/1975 | Nantz | 101/110 |
| 4,023,485 | 5/1977 | Kirby, Jr. | 101/111 |
| 4,146,337 | 3/1979 | Li | 400/174 X |
| 4,176,600 | 12/1979 | Sato | 101/111 |

OTHER PUBLICATIONS

Wood, Jr.; Frank W., "Stop Devices", *Machine Design,* Oct. 27, 1960, vol. 31, No. 43, p. 144.

*Primary Examiner*—Edgar S. Burr
*Assistant Examiner*—C. A. Pearson
*Attorney, Agent, or Firm*—Holman & Stern

[57] ABSTRACT

A rotary type rubber stamp of the present invention comprises an assembly of an endless rubber stamp belt, a pair of guide pulleys mounted on shafts for rotating stamp belt, the shafts being spaced apart from each other and mounted on the inner side walls of a case, the stamp belt having a plurality of unit stamp portions connected with each other through a relatively thin hinge portion of the stamp belt, each of said unit stamp portions having on its back surface widthwise of the stamp belt a ridge-like projection to be engaged with mating grooves formed respectively on the pulleys, one of which pulleys being substantially square in section and the other being circular in section, and cooperating projections and recesses on the square pulley and inner side walls of the case, respectively, for releasably retaining the stamp in position during use.

1 Claim, 3 Drawing Figures

ROTARY TYPE RUBBER STAMP

BRIEF SUMMARY OF THE INVENTION

This invention relates to a rotary type rubber stamp comprising an endless rubber stamp belt rotatable on a pair of guide pulleys which are mounted within a case so that one of the unit stamp portions may be impressed.

The endless rubber stamp belt has a plurality of unit stamp portions connected with each other through a relatively thin hinge portion of the stamp belt.

Although similar kinds of stamps have heretofore been known, this invention aims at improving the construction and practical value of conventional rubber stamps and providing a rotary type rubber stamp in which each of the unit stamp portions of the rubber stamp belt is, in use, securely retained in a fixed position so as to be clearly impressed on any surfaces to be stamped.

Another object of the present invention is to provide a rotary type rubber stamp wherein the rotary operation of the endless rubber stamp belt is smoothly carried out.

BRIEF DESCRIPTION OF THE SEVERAL VIEWS OF THE DRAWING

The accompanying drawings show one preferred embodiment of the rotary type rubber stamp according to this invention, wherein.

DETAILED DESCRIPTION

Figure 2:
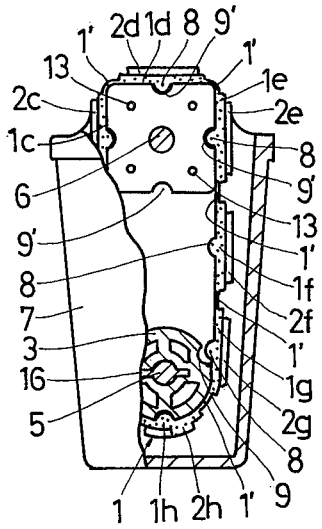
FIG. 2 is a side view partly in section of the stamp of FIG. 1.
Figure 1:
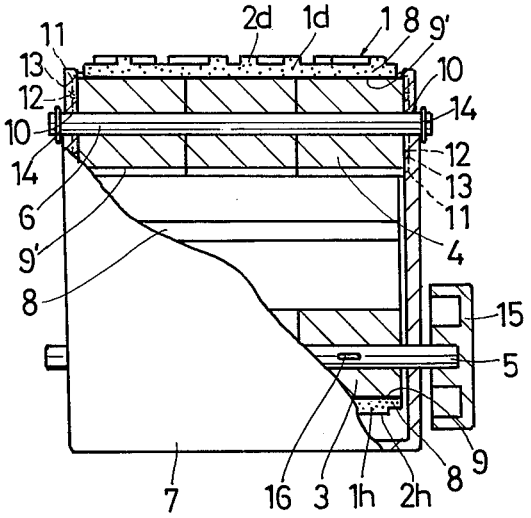
FIG. 1 is an elevational view partly in section of the rubber stamp of this invention.
Figure 3:
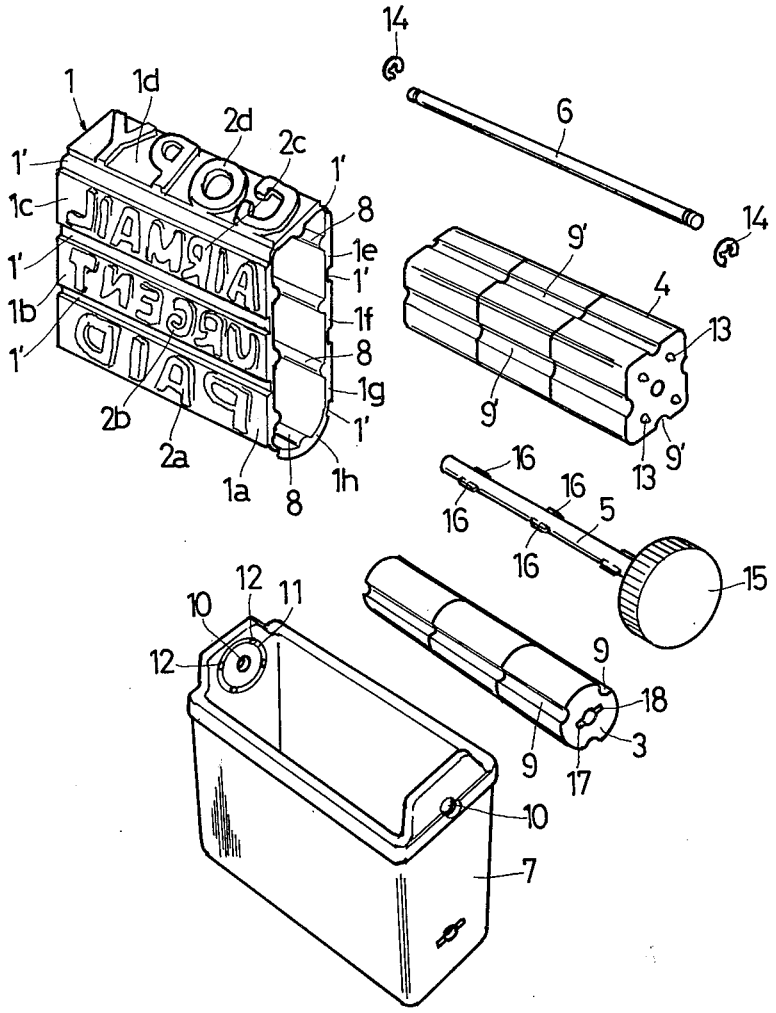
FIG. 3 is an exploded perspective view showing each of the components of the stamp of FIG. 1.

Now, a detailed description of a rotary type rubber stamp according to this invention will be given hereinafter by way of example with reference to the accompanying drawings.

In the drawings, 1 is an endless rubber stamp belt comprising a plurality of unit stamp portions 1*a*, 1*b*, 1*c* . . . 1*h*, said belt comprising also a relatively thin hinge portion between each of the unit stamp portions. The endless rubber stamp belt 1 is disposed to run over a pair of guide pulleys 3 and 4, the pulley 3 being substantially circular in cross section and the pulley 4 substantially square in cross section, each rotatably mounted on the shafts 5 and 6 respectively in the upper and lower positions within a box-like case 7. On the back side of each of the unit stamp portions 1*a*, 1*b*, 1*c* . . . 1*h* of the endless rubber stamp belt 2, there is provided an elongated ridge-like projection 8 widthwise of the belt 1,which projection is adapted to fit in the mating grooves 9, 9' formed respectively at a predetermined spacing on the peripheral surfaces of the guide pulleys 3 and 4.

On both side walls of the box-like case 7 serving also as bearings for the pulleys 3 and 4, there are formed bearing holes 10, 10 for the shaft 6 of the pulley 4 and on the internal surface of the wall around the holes 10, 10 there are also formed the concentric circles 11, 11 having a plurality of recesses 12 formed therein so as to receive the projections 13 provided on both end surfaces of the pulley 4, the number of said projections 13 being the same as the number of recesses 12.

The reference numeral 14 indicates retainer rings for the shaft 6. 15 is a handle fixed on the rotary shaft 5 of the guide pulley 3. The rotary shaft 5 is provided with a plurality of projections 16 formed thereon for preventing rotation of the shaft 5 with respect to pulley 3 by engaging in the grooves 18 extending from the bore 17 in which the shaft 5 engages when inserted into the pulley 3.

The operation of the stamp will now be explained hereinafter.

First, the stamp is held by hand and the shaft 6 is rotated by turning the handle 15, whereby the endless rubber stamp belt will be moved to present the desired unit stamp portions 1*a*, 1*b*, 1*c* . . . 1*h* to the stamping position above the edge of open end of case 7 so that the stamp can be impressed. At the moment when the stamp is impressed, the projections 8 formed on the back surface of the stamp belt 2 engage with the groove 9' of the square pulley 4 and the projections 13 of the square pulley 4 move within the concentric grooves 11 and engage with the recesses 12 so that the stamp belt may be stabilized and the letter molds on the desired unit stamp portion may clearly be impressed. Thus, the unit stamp portion of the rubber stamp according to this invention is given the necessary stabilization that is not provided by conventional rotary type stamps so that the practical use of rotary type rubber stamps is remarkably improved.

I claim:

1. In a rotary type rubber stamp, comprising a case, an endless rubber stamp belt disposed to run over a rotatable square guide pulley and a rotatable circular guide pulley each mounted on a shaft in spaced relationship within the case, said stamp belt comprising a plurality of unit stamp portions with letter molds projectingly formed thereon and a relatively thin hinge portion between each of said unit stamp portions, the improvement comprising said case having substantially rectangular cross-sectional shape being closed at one end and open at the other end, said pulleys being mounted on central shafts rotatably mounted at their ends in bearing holes in the side walls of said case, said square guide pulley having substantially flat ends and being positioned at said open end of said case with said flat ends in close proximity to the inner surface of said side walls, and means for releasably retaining said unit stamp portions in stamping position comprising a circular groove in the inner surface of each side wall concentric with the rotational axis of said square guide pulley shaft, a plurality of recesses in said grooves, and projections on said flat ends of the square guide pulley positioned at the same radius as said recesses to engage said recesses, said projections on each said flat end corresponding in number to said recesses in the adjacent side wall, the shaft of said circular guide pulley is provided with an extension which extends through said side wall, a handle mounted on said extension for rotating said circular guide pulley and thereby said square guide pulley through said endless belt; and each unit stamp portion, when in position for stamping, is exposed through said open end of said case on one face only of said square pulley and the other unit stamp portions are substantially completely contained within said case.

* * * * *